US005266226A

United States Patent [19]

Habeeb et al.

[11] Patent Number: 5,266,226

[45] Date of Patent: Nov. 30, 1993

[54] ASHLESS LUBE ADDITIVES CONTAINING COMPLEXES OF ALKOXYLATED AMINE, DITHIOBENZOIC ACID AND ADENINE (PNE-639)

[75] Inventors: Jacob J. Habeeb; Morton Beltzer, both of Westfield, N.J.

[73] Assignee: Exxon Research & Engineering Company, Florham Park, N.J.

[21] Appl. No.: 21,506

[22] Filed: Feb. 22, 1993

[51] Int. Cl.[5] ..... C10M 133/38; C10M 159/12

[52] U.S. Cl. ..... 252/47.005; 252/51.005 R; 544/264

[58] Field of Search ..... 252/47.5, 51.5; 544/264

[56] References Cited

U.S. PATENT DOCUMENTS

| | | | |
|---|---|---|---|
| 4,367,152 | 1/1983 | Wright et al. | 252/47.5 |
| 4,382,006 | 5/1983 | Horodysky | 252/49.6 |
| 5,076,945 | 12/1991 | Habeeb et al. | 252/47.5 |
| 5,108,462 | 4/1992 | Habeeb et al. | 44/383 |

*Primary Examiner*—Jacqueline V. Howard
*Assistant Examiner*—Cephia D. Toomer
*Attorney, Agent, or Firm*—James H. Takemoto

[57] ABSTRACT

A composition of matter having utility in lubricant formulation, said composition being the reaction product of adenine, alkoxylated amine and hydrocarbyldithiobenzoic acid and having the formula (I):

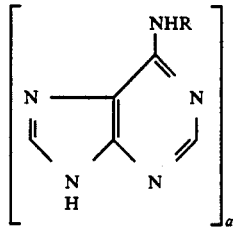

(I)

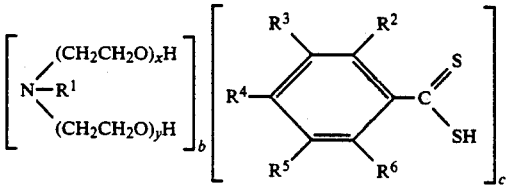

where R is hydrogen or a hydrocarbyl group of 1 to 20 carbon atoms, $R^1$ is a hydrocarbyl group of 2 to 22 carbon atoms, $R^2$, $R^3$, $R^4$, $R^5$ and $R^6$ are each independently hydrogen, a hydrocarbyl group containing from 1 to 24 carbon atoms or a hydroxy group with the proviso that at least one of $R^2$ to $R^5$ is a hydrocarbyl group, x and y are each independently integers of from 1 to 15 with the proviso that the sum of x+y is from 2 to 20, and a, b and c are independent numbers from 1.0 to 3.0 wherein the ratios between a:b, a:c and b:c range from 1.0:3.0 to 3.0:1.0.

16 Claims, No Drawings

ASHLESS LUBE ADDITIVES CONTAINING COMPLEXES OF ALKOXYLATED AMINE, DITHIOBENZOIC ACID AND ADENINE (PNE-639)

BACKGROUND OF THE INVENTION

1. Field of the Invention

This invention relates to the reaction product of adenine, alkoxylated amine and hydrocarbyldithiobenzoic acid and to an improved lubricating oil composition containing the reaction product which shows excellent friction reducing properties.

2. Description of the Related Art

In order to protect internal combustion engines from wear, engine lubricating oils have been provided with antiwear and antioxidant additives. The primary oil additive for the past 40 years for providing antiwear and antioxidant properties has been zinc dialkyldithiophosphate (ZDDP). U.S. Pat. No. 5,076,945 discloses a lubricating oil composition containing an amine salt of a dithiobenzoic acid. The amines used to prepare salts are long chain hydrocarbyl amines.

Oil additive packages containing ZDDP have environmental drawbacks. ZDDP adds to engine deposits which can lead to increased oil consumption and emissions. Moreover, ZDDP is not ash-free and contains phosphorus. Most current commercial engine oils contain reduced phosphorus due to the poisoning of the catalytic coverters by phosphorus. Various ashless oil additive packages have been developed recently due to such environmental concerns. However, many ashless additive packages tend to be corrosive to copper which leads to additional components in the additive package to protect against corrosion.

It would be desirable to have a lubricating oil additive which provides excellent antiwear, antioxidation, fuel economy and environmentally beneficial (less fuel, less phosphorus, i.e., less exhaust emissions) properties while at the same time protecting the engine from copper corrosion.

SUMMARY OF THE INVENTION

The present invention relates to a novel composition of matter containing adenine, alkoxylated amine and hydrocarbyldithiobenzoic acid and to an improved lubricating oil composition which, in addition to providing friction reudcing properties, also provides antiwear, antioxidation fuel economy and copper corrosion inhibition properties. The composition of matter has the general formula (I) and is a complex comprising the reaction product of adenine, alkoxylated amine and hydrocarbyldithiobenzoic acid, said complex having the formula

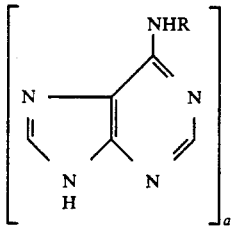

(I)

-continued

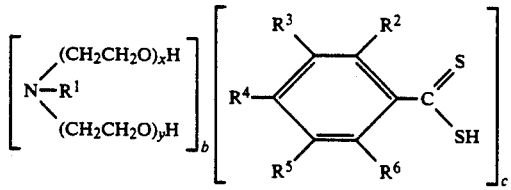

where R is hydrogen or hydrocarbyl group of from 1 to 20 carbon atoms, $R^1$ is a hydrocarbyl group of 2 to 22 carbon atoms, $R^2$, $R^3$, $R^4$, $R^5$ and $R^6$ are each independently hydrogen, a hydrocarbyl group containing from 1 to 24 carbon atoms or a hydroxy group with the proviso that at least one of $R^2$ to $R^5$ is a hydrocarbyl group, x and y are each independently integers of from I to 15 with the proviso that the sum of x +y is from 2 to 20, and a, b and c are independent numbers from 1.0 to 3.0 wherein the ratios between a:b, a:c and b:c range from 1.0:3.0 to 3.0:1.0.

The present invention is also directed to a lubricant composition comprising (a) a major amount of a lubricating oil basestock and (b) a minor amount of a complex having the general formula (I) and a method for reducing friction and providing antiwear protection in an interval combustion engine comprising operating the engine with a lubricating oil containing an amount effective to reduce friction of a complex of the formula (I).

DETAILED DESCRIPTION OF THE INVENTION

In the lubricating oil composition of the present invention, the lubricating oil will contain a major amount of a lubricating oil basestock. The lubricating oil basestock are well known in the art and can be derived from natural lubricating oils, synthetic lubricating oils, or mixtures thereof. In general, the lubricating oil basestock will have a kinematic viscosity ranging from about 5 to about 10,000 cSt at 40° C., although typical applications will require an oil having a viscosity ranging from about 10 to about 1,000 cSt at 40° C.

Natural lubricating oils include animal oils, vegetable oils (e.g., castor oil and lard oil), petroleum oils, mineral oils, and oils derived from coal and shale.

Synthetic oils include hydrocarbon oils and halo-substituted hydrocarbon oils such as polymerized and interpolymerized olefins, alkylbenzenes, polyphenyls, alkylated diphenyl ethers, alkylated diphenyl sulfides, as well as their derivatives, analogs, and homologs thereof, and the like. Synthetic lubricating oils also include alkylene oxide polymers, interpolymers, copolymers and derivatives thereof wherein the terminal hydroxyl groups have been modified by esterification, etherification, etc. Another suitable class of synthetic lubricating oils comprises the esters of dicarboxylic acids with a variety of alcohols. Esters useful as synthetic oils also include those made from $C_5$ to $C_{12}$ monocarboxylic acids and polyols and polyol ethers.

Silicon-based oils (such as the polyakyl-, polyaryl-, polyalkoxy-, or polyaryloxy-siloxane oils and silicate oils) comprise another useful class of synthetic lubricating oils. Other synthetic lubricating oils include liquid esters of phosphorus-containing acids, polymeric tetrahydrofurans, polyalphaolefins, and the like.

The lubricating oil may be derived from unrefined, refined, rerefined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

In the oil soluble complexes of the present invention having the general formula (I), R is preferably a hydrocarbyl group of from 1 to 16 carbon atoms or hydrogen, most preferably hydrogen, $R^1$ is preferably a hydrocarbyl group of from 2 to 18 carbon atoms, especially 6 to 18 carbon atoms. $R^2$ to $R^6$ are each preferably hydrogen; a hydrocarbyl group containing from 1 to 18 carbon atoms; or a hydroxy group with the proviso that at least one of $R^2$ to $R^6$ is a hydrocarbyl, preferably an alkyl group containing 1 to 18 carbon atoms, more preferably I to 6 carbon atoms. $R^3$ and $R^5$ are most preferably t-butyl groups and $R^4$ is preferably hydroxy. The sum of $x+y$ is preferably 2 to 15. The above hydrocarbyl groups include aliphatic (alkyl or alkenyl) and alicyclic groups which may be substituted by hydroxy, amino, cyano and the like and may be interrupted by O, S or N.

The complexes are the reaction product of an alkoxylated, preferably a propoxylated or ethoxylated, especially an ethoxylated amine of the formula

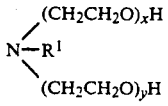

(a)

where $R^1$, x and y are defined as described above, a hydrocarbyldithiobenzoic acid of the formula

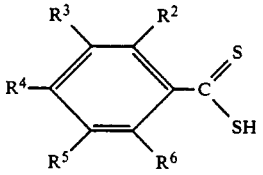

(b)

where $R^2$ to $R^6$ are defined as described above, and an adenine of the formula

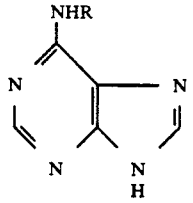

(c)

where R is defined as described above.

Alkoxylated amines of the formula (a) and adenines of the formula (c) are commercially available compounds or may be prepared by methods known in the art. For example, ethoxylated amines are manufactured by Sherex Chemicals under the trade name Varonic ® and by Akzo Corporation under the trade name(s) Ethomeen ® and Ethoduomeen ®. Adenine may be purchased from Aldrich Chemical Company. Examples of preferred amines of the formula (a) include ethoxylated (5) cocoalkylamine, ethoxylated (15) cocoalkylamine, ethoxylated (2) tallowalkylamine and ethoxylated (10) stearylamine. Propoxylated amines may be substituted for ethoxylated amines.

Dithiobenzoic acids maybe prepared from a phenol according to the following method. A phenol of the formula

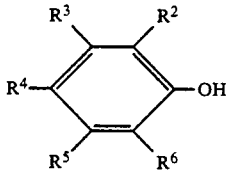

is dissolved in a solvent such as dimethylsulfoxide and treated under nitrogen with potassium hydroxide dissolved in a minimum amount of water. Carbon disulfide is then added under nitrogen to this mixture, which is maintained at about room temperature. The resulting reaction mixture is heated at between 25° to 100° C. for 1-3 hours and then added to an acidified water solution. The resulting dithiobenzoic acid can be isolated by solvent extraction using, e.g. ether and the solvent evaporated.

The complexes having the general formula (I) are prepared as described below. This preparation is based on an approximate 1:1:1 mole ratio although this ratio may vary. About 10 to 20% of the required amount of alkoxylated amine (based on thiobenzoic acid) is added to dithiobenzoic acid with heating and stirring. Temperatures may range from about 25° to about 180° C. About 10 to 20% of the required amount of adenine is then added. This sequential addition process is repeated until the required amounts (based on the above approximate 1:1:1 of amine:acid: adenine) is reached. A precipitate (polymeric and unidentified material) forms if this alternate addition procedure is not employed.

The precise stoichiometry of the bonding in the complexes of the formula (I) is not known since each molecule in the complex may have several sites which can take part in the hydrogen bonding process either as an acceptor or donor. Because of the multipilicity of bonding possibilities, the molar ratios a:b:c can be varied over a wide range based on the donor/acceptor sites on each of the three molecules and therefore a, b and c in formula (I) are numbers which are not necessarily integral. There exist a total of fifteen combinations of interaction sites between the three molecules comprising the complex of the formula (I). For example, a:b:c may be 1:2:1 or 1:1:3 which are just two of the fifteen possible combinations.

The present lubricating oil composition contains a major amount of lubricating oil basestock and an effective amount necessary to impart antiwear, antioxidation, fuel economy and anticorrosion properties to the oil. The concentration of complex of the general formula (I) may typically range from about 0.1 to about 5 wt.%, based on oil, preferably about 0.5 to about 1.5 wt.%.

If desired, other additives known in the art may be added to the lubricating oil basestock. Such additives include dispersants, other antiwear agents, other antioxidants, corrosion inhibitors, detergents, pour point depressants, extreme pressure additives, viscosity index improvers, friction modifiers, and the like. These additives are typically disclosed, for example in "Lubricant Additives" by C. V. Smalhear and R. Kennedy Smith, 1967, pp. 1-11 and in U.S. Pat. No. 4,105,571, the disclosures of which are incorporated herein by reference.

The complex and lubricating oil composition of the invention are further illustrated by the following examples which also illustrate a preferred embodiment.

EXAMPLE 1

A solution of 3 g ethoxylated (5) cocoalkylamine was heated to 50°-110° C. with stirring. 0.5 g of 4-hydroxy-3,5-ditertiary butyldithiobenzoic acid was then added to the heated and stirred solution followed by 125 mg of adenine. This procedure of sequentially adding the dithiobenzoic and adenine was repeated until 2 g of the acid and 50 mg of adenine have been added to the solution. The sequential procedure was employed to prevent precipitation of by-product polymeric materials.

EXAMPLE 2

Ball on Cylinder (BOC) friction tests were performed on the ethoxylated (5) cocoalkylamine:dithiobenzoate:adenine complex from Example 1 in S 150N base oil using several concentrations of the additive. The BOC tests were performed using the experimental procedure described by S. Jahanmir and M. Beltzer in ASLE Transactions, 29, No. 3, p. 425 (1985) except that a force of 0.8 Newtons (1 Kg) rather than 4.9 Newtons was applied to a 12.5 mm steel ball in contact with a rotating steel cylinder having a 43.9 mm diameter. The cylinder rotates inside a cup containing a sufficient quantity of lubricating oil to cover 2 mm of the bottom of the cylinder. The cylinder was rotated at 0.25 rpm. The frictional force was continuously monitored by means of a load transducer. In the tests conducted, friction coefficients attained steady state values after 7 to 10 turns of the cylinder. Friction experiments were run at an oil temperature at 100° C. The data is shown in Table 1.

TABLE 1

| Pt | Concentration (wt. %) in solvent 150N* | Coefficient of Friction: Ethoxylated (5) coco-amine:DTB: Adenine | Ethoxylated (5) Coco-amine:DTB | Primene** JMT:DTB |
|---|---|---|---|---|
| 1 | 0 | 0.37 | 0.37 | 0.37 |
| 2 | 0.05 | 0.22 | 0.121 | — |
| 3 | 0.1 | 0.17 | 0.107 | 0.3 |
| 4 | 0.2 | 0.13 | — | — |

TABLE 1-continued

| Pt | Concentration (wt. %) in solvent 150N* | Coefficient of Friction: Ethoxylated (5) coco-amine:DTB: Adenine | Ethoxylated (5) Coco-amine:DTB | Primene** JMT:DTB |
|---|---|---|---|---|
| 5 | 0.4 | — | 0.107 | — |
| 6 | 0.5 | 0.07 | — | 0.21 |
| 7 | 0.6 | — | 0.107 | — |
| 8 | 0.8 | 0.06 | 0.107 | 0.177 |

*S150 is a solvent extracted, dewaxed, hydrofined neutral lube base stock obtained from approved paraffinic crudes (viscosity, 32 cSt at 40° C., 150 Saybolt seconds)
**Primene JMT is predominantly a $C_{18}$ t-alkyl primary amine manufactured by Rohm & Haas.

As can be seen from the data in Table 1, the adenine-containing complex achieves lower coefficient of friction than can be obtained from the comparable complex without adenine or a Primene JMT:DTB complex.

What is claimed is:

1. A composition of matter comprising a complex which is the reaction product of adenine, alkoxylated amine and hydrocarbyldithiobenzoic acid, said complex having the formula (I)

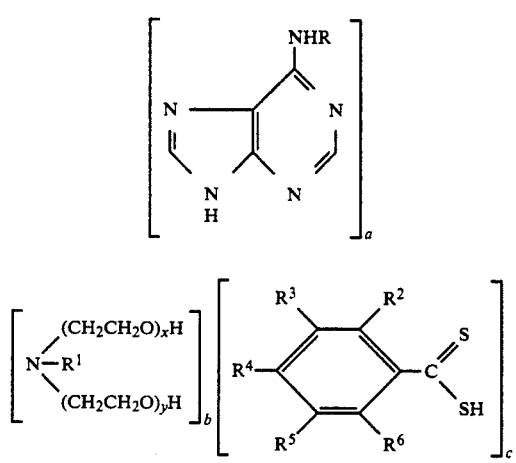

where R is hydrogen or a hydrocarbyl group of 1 to 20 carbon atoms, $R^1$ is a hydrocarbyl group of 2 to 22 carbon atoms, $R^2$, $R^3$, $R^4$, $R^5$ and $R^6$ are each independently hydrogen, a hydrocarbyl group containing from 1 to 24 carbon atoms or a hydroxy group with the proviso that at least one of $R^2$ to $R^5$ is a hydrocarbyl group, x and y are each independently integers of from 1 to 15 with the proviso that the sum of x+y is from 2 to 20, and a, b and c are independent numbers from 1.0 to 3.0 wherein the ratios between a:b, a:c and b:c range from 1.0:3.0 to 3.0:1.0.

2. The composition of claim 1 wherein $R^1$ is alkyl or alkenyl of 2 to 18 carbon atoms.

3. The composition of claim 1 wherein the sum of x+y is from 2 to 15.

4. The composition of claim 1 wherein R is hydrogen.

5. The composition of claim 1 wherein at least one of $R^2$ to $R^6$ is alkyl containing from 1 to 18 carbon atoms.

6. The composition of claim 1 wherein $R^4$ is a hydroxy group.

7. The composition of claim 1 wherein $R^3$ and $R^5$ are t-butyl.

8. A lubricating oil composition comprising (a) a major amount lubricating oil basestock, and (b) a minor amount of a complex comprising the reaction product of adenine, alkoxylated amine and hydrocarbyldithiobenzoic acid, said complex having the formula (I)

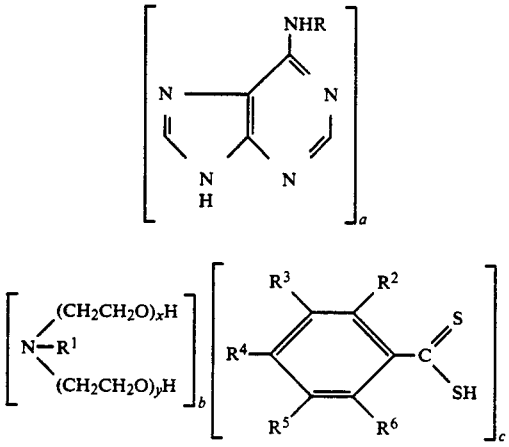

where R is hydrogen or a hydrocarbyl group of 1 to 20 carbon atoms, $R^1$ is a hydrocarbyl group of 2 to 22 carbon atoms, $R^2$, $R^3$, $R^4$, $R^5$ and $R^6$ are each independently hydrogen, a hydrocarbyl group containing from 1 to 24 carbon atoms or a hydroxy group with the proviso that at least one of $R^2$ to $R^5$ is a hydrocarbyl group, x and y are each independently integers of from 1 to 15 with the proviso that the sum of x+y is from 2 to 20, and a, b and c are independent numbers from 1.0 to 3.0 wherein the ratios between a:b, a:c and b:c range from 1.0:3.0 to 3.0:1.0.

9. The composition of claim 8 wherein $R^1$ is alkyl or alkenyl of 2 to 18 carbon atoms.

10. The composition of claim 8 wherein the sum of x+y is from 2 to 15.

11. The composition of claim 8 wherein R is hydrogen.

12. The composition of claim 8 wherein at least one of $R^2$ to $R^6$ is alkyl containing from 1 to 18 carbon atoms.

13. The composition of claim 8 wherein $R^3$ and $R^5$ are t-butyl.

14. The composition of claim 8 wherein the concentration of the complex is from 0.1 to about 5 wt.%.

15. The composition of claim 8 wherein $R^4$ is a hydroxy group.

16. A method for reducing friction and providing antiwear protection in an interval combustion engine which comprises operating the engine with a lubricating oil composition containing an amount effective to reduce friction of the complex of claim 8.

* * * * *